US005131455A

United States Patent [19]

Tsuchiyama et al.

[11] Patent Number: 5,131,455

[45] Date of Patent: Jul. 21, 1992

[54] LOW POWER ELECTRICAL FAN MOTOR AND HEATER THERMAL PROTECTION CIRCUIT FOR AIR CONDITIONER

[75] Inventors: Yuji Tsuchiyama; Kikuo Takekawa; Masayuki Shimizu, all of Gumma, Japan

[73] Assignee: Sanyo Electric Co., Ltd., Osaka, Japan

[21] Appl. No.: 645,588

[22] Filed: Jan. 24, 1991

[30] Foreign Application Priority Data

Feb. 8, 1990 [JP] Japan ..... 2-28957
Feb. 8, 1990 [JP] Japan ..... 2-28958

[51] Int. Cl.[5] ..... F25B 29/00; F24F 11/02; H02H 5/04; H01H 9/00

[52] U.S. Cl. ..... 165/29; 165/62; 165/64; 392/360; 219/519; 361/32; 361/189

[58] Field of Search ..... 165/62, 29, 64; 392/360; 219/519; 361/26, 27, 31, 32, 189, 190

[56] References Cited

U.S. PATENT DOCUMENTS

| | | | |
|---|---|---|---|
| Re. 26,596 | 6/1969 | Jobes | 165/29 |
| 1,991,280 | 2/1935 | Hynes | 392/360 |
| 2,080,797 | 5/1937 | Wiegand | 392/360 |
| 2,080,799 | 5/1937 | Wiegand | 392/360 |
| 2,969,959 | 1/1961 | Kuhn et al. | 165/29 |
| 3,316,960 | 5/1967 | Miner | 392/360 |
| 3,694,625 | 9/1972 | Cole | 392/360 |
| 3,731,056 | 5/1973 | Becker | 392/360 |
| 3,799,245 | 3/1974 | Ferdelman | 165/29 |
| 3,912,906 | 10/1975 | McIntosh et al. | 392/360 |
| 4,048,666 | 9/1977 | Irie et al. | 361/189 |
| 4,898,230 | 2/1990 | Tsuchiyama et al. | 165/29 |

FOREIGN PATENT DOCUMENTS

| | | | |
|---|---|---|---|
| 59-6346 | 2/1984 | Japan . | |
| 0819557 | 4/1981 | U.S.S.R. | 392/360 |

*Primary Examiner*—John K. Ford
*Attorney, Agent, or Firm*—Heller, Ehrman, White, McAuliffe

[57] ABSTRACT

An air conditioner has a refrigeration system with a compressor, a motor for air-circulating fans, indoor and outdoor heat exchangers and a four-way valve connected through refrigerant conduits such that it can be operated selectably both for cooling and for heating. An electric heater is also provided for heating. An electrical circuit for the air conditioner has a series connection of (1) a first temperature switch which opens when the temperature of the motor becomes too high, (2) a thermostat of an ordinary kind which places its connector piece in an open or closed position by comparing room temperature with a user-set temperature level, (3) a relay which controls the switching of the compressor of the air conditioner on and off, and (4) a second temperature switch which opens when the temperature of the electric heater becomes too high.

7 Claims, 6 Drawing Sheets

| MODE | HEAT | | | | | | COOL | | |
|---|---|---|---|---|---|---|---|---|---|
| FIRST CONNECTOR PIECE | H | H | H | H | L | L | L | L | H |
| SECOND CONNECTOR PIECE | ON | OFF | ON | OFF | ON | OFF | ON | ON | ON |
| FROST DETECTOR | ON | ON | OFF | OFF | ON/OFF | ON/OFF | ON/OFF | ON/OFF | ON/OFF |
| COMPRESSOR | - | - | - | ON HEAT PUMP | - | - | ON (COOLING) | | - |
| HEATER | ON | ON | ON | - | - | - | - | - | - |
| OUTDOOR AIR CIRCULATION FAN | - | - | - | ON | - | - | ON | ON | - |
| FOUR - WAY VALVE | ON | ON | ON | ON | ON | ON | - | - | - |

FIG._6

LOW POWER ELECTRICAL FAN MOTOR AND HEATER THERMAL PROTECTION CIRCUIT FOR AIR CONDITIONER

BACKGROUND OF THE INVENTION

This invention relates to an electrical circuit for an air conditioner and more particularly to a protection circuit for an air conditioner having an electric heater.

U.S. Pat. No. 4,898,230 has disclosed a control system for an air conditioner which may be characterized as having a bimetallic temperature switch or the like connected in series with an electric heater such that the switch opens and the electrical power supply to the heater is cut off when the temperature of the heater exceeds a set level. With such a control system, however, the maximum current which can pass through the switch must not be less than that through the heater because they are connected in series, and this tends to slow down the opening and closing of the switch. In order to compensate for this slow down, the temperature setting must be made somewhat lower but, if a lower temperature is set, the switch may be inadvertently activated when, for example, the filter has become choked and the air flow by the air circulating system reduced.

SUMMARY OF THE INVENTION

It is therefore an object of the present invention to provide an improved electrical circuit for an air conditioner with a temperature switch which can respond quickly.

It is another object of the present invention to provide such an electrical circuit which can operate dependably without regard to the condition of the air circulating system.

The air conditioner is assumed to be of the kind having not only a refrigeration system with a compressor, a motor for air circulation means, indoor and outdoor heat exchangers and a valve means connected through refrigerant conduits such that it can be operated selectably both for cooling and for heating, but also an electric heater disposed in the passage of air blown by the air circulation means. A control system of such an air conditioner with which the above and other objects can be achieved may be characterized as having a series connection of (1) a first temperature switch which opens when the temperature of the motor becomes too high, (2) a thermostat of an ordinary kind which places its connector piece in an open or closed position by comparing the detected room temperature with a user-set temperature level, (3) a relay which controls to switch the compressor of the air conditioner on and off, and (4) a second temperature switch which opens when the temperature of the electric heater becomes too high.

With a control system thus structured, electrical power supply to the relay is cut off when the electric heater becomes excessively hot and this causes the electrical power supply to the heater stopped. Similarly, in an abnormal situation where the motor is overheated, its temperature switch opens to cause the electrical power supply to the relay stopped and this in turn stops the supply of power to the heater.

BRIEF-DESCRIPTION OF THE DRAWINGS

The accompanying drawings, which are incorporated in and form a part of the specification, illustrate embodiments of the present invention and serve to explain the principles of the invention. In the drawings:

FIG. 6 is a table for showing the operations of the compressor, electric heater, outdoor air circulating fan and four-way valve of the air conditioner of FIGS. 4 and 5.

DETAILED DESCRIPTION OF THE INVENTION

Figure 1:
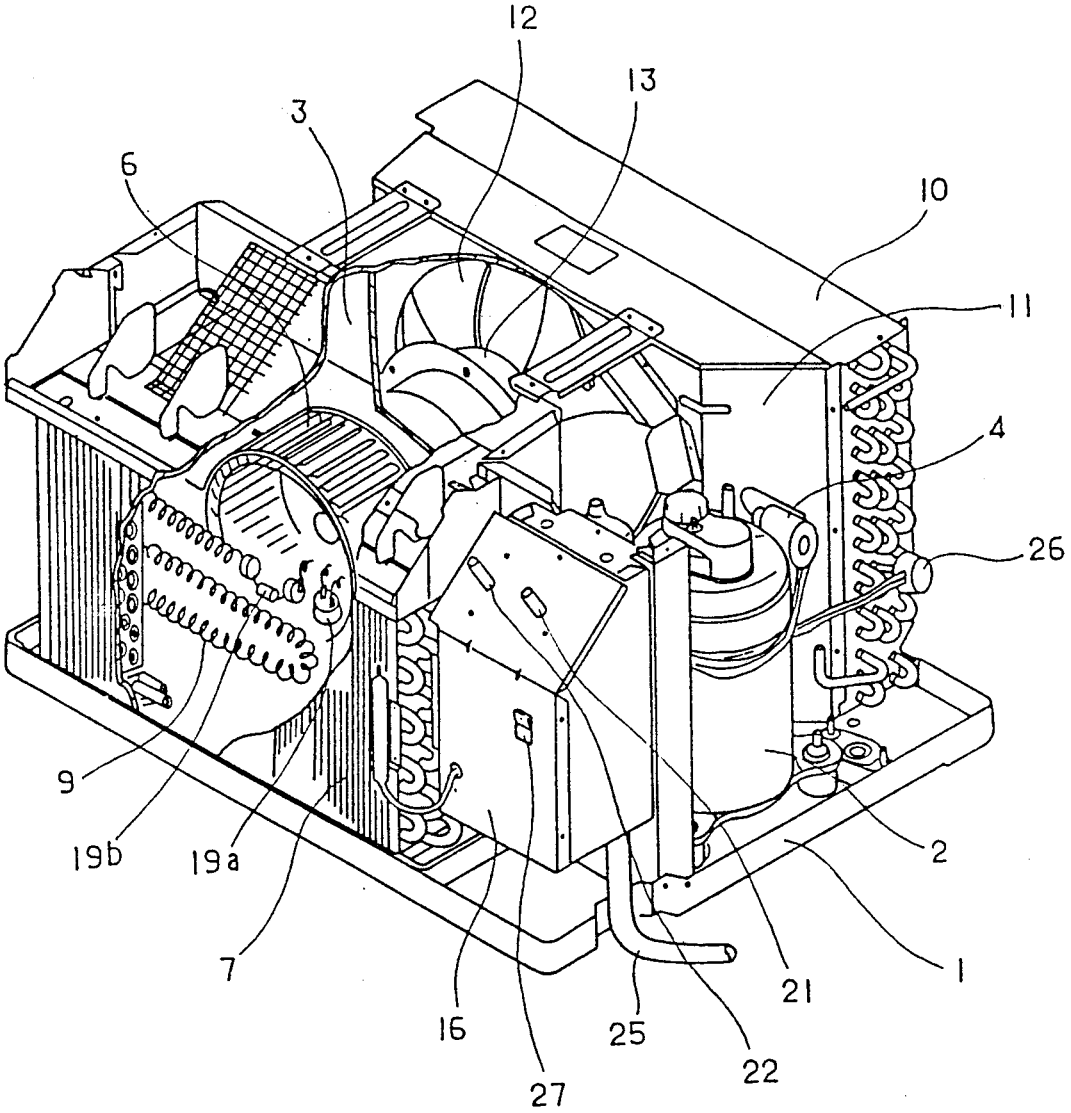
FIG. 1 is a diagonal interior view of an air conditioner embodying the present invention with its casing removed and in part cut out.
Figure 2:
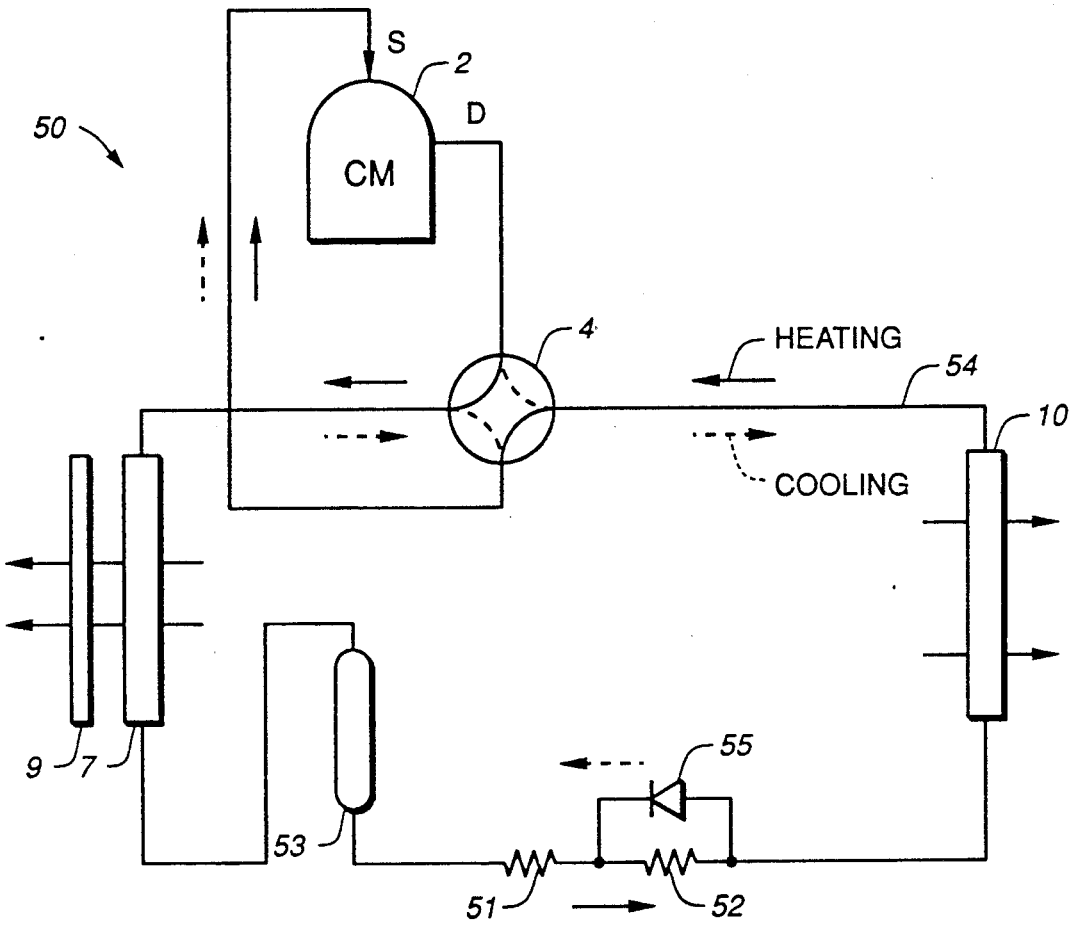
FIG. 2 is a refrigeration system of the air conditioner of FIG. 1.

With reference to FIG. 1 intended to show the internal structure of an air conditioner embodying the present invention, numeral 1 indicates a metallic base plate, numeral 2 indicates a compressor CM, numeral 7 indicates an indoor heat exchanger (on the side of the room to be air-conditioned referred hereinafter simply to as "the room"), numeral 10 indicates an outdoor heat exchanger (on the side of the heat source), and numeral 4 indicates a four-way valve (FV). As shown schematically in FIG. 2, they are in refrigerant flow relationship together with expansion means 51 and 52 and a heat reservoir 53 by suitable refrigerant conduits 54 to form a refrigeration system 50. A check valve 55 through which a refrigerant flows in the direction of the dotted line only at cooling operation is connected to the expansion means 52. When the four-way valve 4 is in a state as shown by the solid line in FIG. 2, the refrigerant discharged from the compressor 2 flows in the direction of the solid arrows, the indoor heat exchanger 7 operates as a condenser, the outdoor heat exchanger 10 operates as an evaporator, and an indoor air circulating fan 6 (a sirocco fan) and an outdoor air circulating fan 12 (a propeller fan) operate to heat the room. When the four-way valve 4 is switched to a state as shown by the dotted line in FIG. 2, the refrigerant discharged from the compressor 2 flows in the direction of the dotted arrows, the indoor heat exchanger 7 operates as an evaporator, the outdoor heat exchanger 10 operates as a condenser, and the air conditioner performs the cooling operation.

A partition wall 3 separates the interior of the air conditioner into an indoor-side chamber and an outdoor-side chamber. The outdoor-side chamber contains the compressor 2, the outdoor air circulating fan 12, the outdoor heat exchanger 10 and a fan casing 11. Numeral 13 indicates an induction motor for the outdoor air circulating fan 12 which serves to suck in outside air through backside grills and to cause it to flow by a side of the outdoor heat exchanger 10 and into it from the backside of the fan casing 11. A frost detector 26 is provided at a side of the outdoor heat exchanger 10, its connector switching from an H terminal to an L terminal, as described below, when frost is detected.

The indoor-side chamber contains the indoor air circulating fan 6, the indoor heat exchanger 7 and an electric heater 9. The indoor air circulating fan 6 is connected to the shaft of the motor 13 together with the outdoor air circulating fan 12 so as to rotate together therewith as the motor 13 is activated. In other words, as the motor 13 is activated, the air from the room sucked through indoor inlet (front) grills is cooled or heated by the indoor heat exchanger 7 and, after heated by the electric heater 9, is pushed back into the room through outlet grills on the indoor side. The inlet and outlet grills are formed in a cabinet of a synthetic resin material attached to the base plate 1.

With reference still to FIG. 1, numeral 19*a* indicates a temperature (protect) switch which detects the temperature of the electric heater 9 and opens its connector when the detected temperature is higher than a preset level. Numeral 19*b* indicates a fuse of the kind which is melted when the current to the electric heater 9 exceeds a certain preset maximum value. Numeral 16 indicates a switch box containing a control circuit board. Numerals 21, 22, and 27 indicates various switches for sending signals to the control unit. Numeral 21 indicates a mode-selection switch for selecting a mode of operation of the air conditioner, available modes including the COOL mode for cooling the room, the FAN mode for circulating air into the room, the OFF mode for stopping the operation of the air conditioner and the HEAT mode for heating the room. Numeral 22 indicates a thermostat for setting the temperature in the room. Numeral 27 indicates a switch for interlocking the on-off operations of the compressor 2 and the indoor and outdoor air circulating fans 6 and 12. Numeral 25 indicates an electrical power chord for supplying power into the switch box 16.

Figure 3:
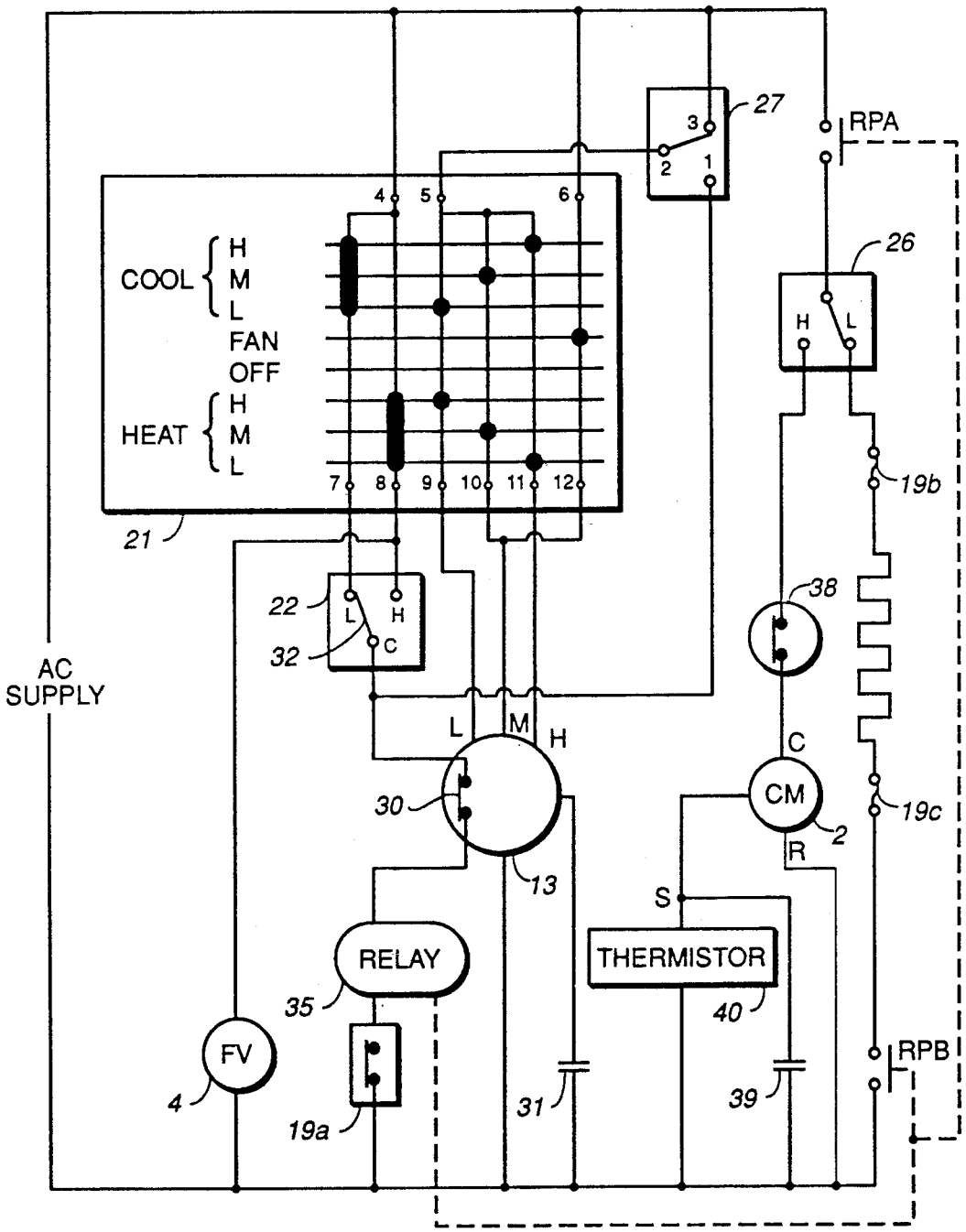
FIG. 3 is a circuit diagram for the air conditioner of FIG. 1.

As shown in FIG. 3. the mode-selection switch 21 is so structured that (1) Terminals 4 and 7 are connected together and Terminal 5 is connected to Terminals 9 and 10 when the COOL mode (H, M or L) is selected; (2) Terminals 6 and 12 are connected together when the FAN mode is selected; (3) No terminals are connected when the OFF mode is selected; and (4) Terminals 4 and 8 are connected together and Terminal 5 is connected to Terminals 9 and 10 when the HEAT mode is selected. The thermostat 22 has a connector piece 32 which connects to Terminal L when the temperature in the room is higher than a set level and to Terminal H when the temperature in the room is lower then the set level. A certain temperature differential is incorporated in order to prevent the chattering of the connector piece 32 when the temperature approaches the set temperature level. The thermostat 22 may be of a known kind such that the user can freely change the set temperature level. Terminal H of the thermostat 22 is connected to Terminal 8 of the mode-selection switch 21. Terminal L of the thermostat 22 is connected to Terminal 7 of the mode-selection switch 21.

The motor 13 includes a high air volume terminal H, a medium air volume terminal M and a low air volume terminal L and contains a temperature (protect) switch 30. This temperature switch 30 is connected in series with the stator winding of the motor 13 and serves to detect the temperature inside the motor 13 (or, in particular, the temperature of its stator winding) and to stop the supply of electrical power to the motor 30 when the detected temperature is higher than a set temperature level. Numeral 31 indicates a capacitor for the operation of the induction motor 13.

The connector piece 32 of the thermostat 22 is connected to an alternate current (AC) power supply through the temperature (protect) switch 19*a*, a relay 35 and the temperature switch 30. The four-way valve 4 is connected between Terminal 8 of the mode-selection switch 21 and the AC power supply. The interlocking switch 27 is so structured that its Terminal 2 can be connected selectively either to its Terminal 1 or 3. If Terminal 2 is connected to Terminal 3, Terminal 5 of the selection switch 21 is effectively connected to the AC power supply such that the motor 13 is operated (in one of the three modes of operation, depending on either it is set for a high, medium or low air flow operation) without regard to whether the compressor 2 is in operation or stopped if the selection switch 21 is selecting the COOL or HEAT mode of operation. If Terminal 2 is connected to Terminal 1, on the other hand, Terminal 5 of the selection switch 21 is effectively connected to Terminal C of the thermostat 22 such that electrical power is supplied to the motor 13 only when electrical power is being supplied to Terminal C of the thermostat 22 (and hence the compressor 2 is in operation).

The relay 37 has normally-open connectors RPA and RPB. The electric heater 9 is connected to the AC power supply through the normally-open connector RPA, Terminal H of the frost detector 26, temperature fuses 19*a* and 19*c* for the heater 9 and the normally-open connector RPB. The compressor 2 is connected to the AC power supply through the normally-open connector RPA, Terminal H of the frost detector 26 and an overload-preventing switch 38 which controls to cut off the electrical power supply to the compressor 2 when a current in excess of a preset level flows to the compressor 2. In FIG. 3, numerals 39 and 40 respectively indicate a capacitor for the operation of the compressor 2 and a thermistor with positive characteristics for the start-up of the compressor 2.

With an electric circuit thus formed, operations of the compressor 2 and the motor 13 are started when the operation is in the HEAT mode, for example, the connector piece 32 of the thermostat 22 connects to its Terminal H and the frost detector 26 is connected to its Terminal H. The air conditioner then operates as a heater since there is a current flow through the fourway valve 4 in this situation and the indoor air circulating fan 6 is operating at the level of air flow to which it is set. If the connector piece 32 of the thermostat 22 connects to its Terminal H but the frost detector 26 is connected to its Terminal L during an operation in the HEAT mode, on the other hand, the operation of the compressor 2 is stopped and electrical power is supplied to the electric heater 9. The motor 13 is operated such that a heating operation is carried out by means of the heater 9.

If the temperature of the electric heater 9 becomes excessively high because, for example, the air filter has become clogged or the inlet grills are blocked, the temperature switch 19*a* opens and the current to the relay 35 is interrupted, thereby opening the normally-open connectors RPA and RPB and cutting off the supply of power to the electric heater 9 and the compressor 2. Since the current that flows through the temperature switch 19*a* need not be large because it is only for driving the relay 35, the current capacity of the temperature switch 19*a* may be small. This means that use may be made of a temperature switch having a quick-reacting connector piece (that is, a fast reaction speed to temperature changes). In other words, the temperature level of the electric heater 9 for protection purpose can be set accurately.

When the motor 15 becomes overloaded and its internal temperature rises, the connector of the temperature switch 30 is opened and the supply of electrical power to the relay 35 is cut off, opening the normally-open connectors RPA and RPB and thereby cutting off the supply of electrical power to the condenser 2 and the electric heater 9.

The connector points in the selection switch 21 for the high, medium and low flow rate operations of the motor 13 are somewhat overlapped such that even if the user leaves the connector somewhere between the low L and medium M positions or between the medium M and high H positions, failure of electrical power supply to the motor can be prevented and the operation of the indoor and outdoor air circulating fans can be maintained. In such a case, a circulating current is generated between the L and M coils or between the M and H coils of the motor and heat is thereby generated in the motor. The heat thus generated in the motor causes the temperature switch 30 in the motor to open, thereby stopping the electrical power supply to the relay 35 and cutting off the power supply to the electric heater 9.

Figure 4:
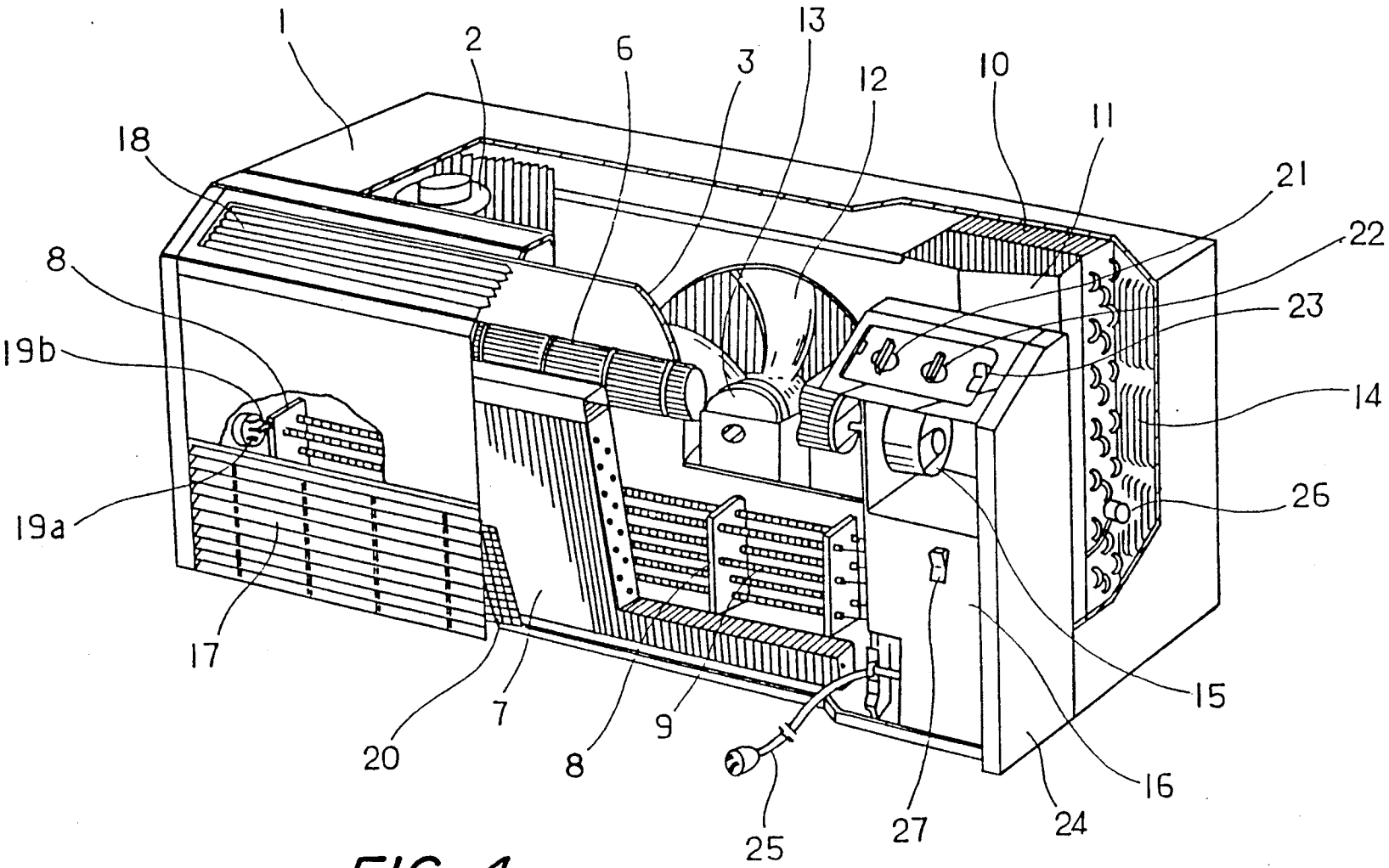
FIG. 4 is a diagonal interior view of another air conditioner embodying the present invention with its casing removed and in part cut out.
Figure 5:
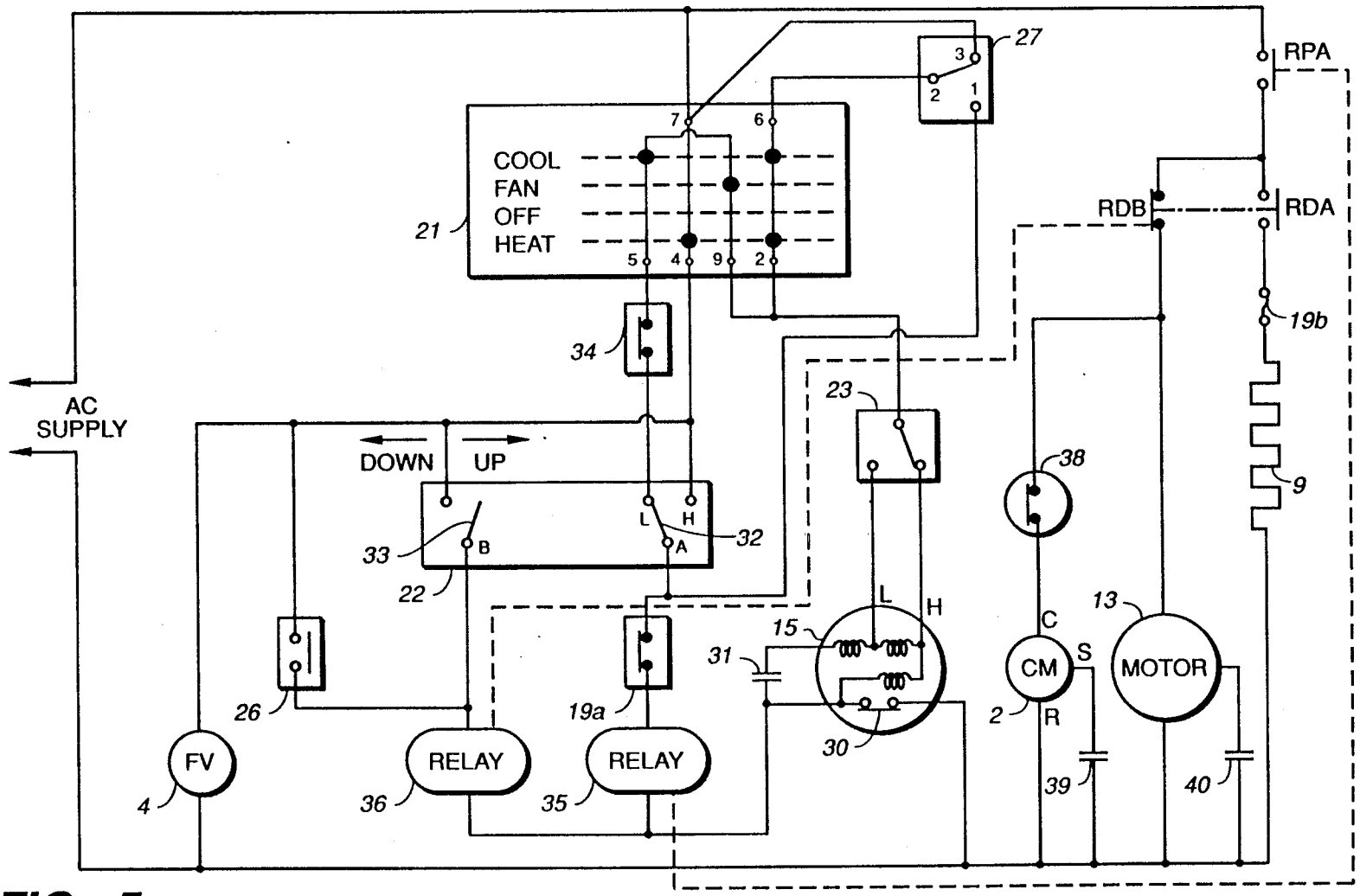
FIG. 5 is a circuit diagram for the air conditioner of FIG. 4.

Another air conditioner embodying the present invention is described next with reference to FIGS. 4 and 5 in order to more clearly demonstrate the features of the present invention. Many of the components of the air conditioner of FIGS. 4 and 5 are nearly identical or at least equivalent to those shown in and explained in connection with FIG. 1 and hence will be indicated by the same numerals. One of the differences between the two air conditioners is that a separate (inductive) motor 15 is provided for the indoor air circulating fan 6, the outdoor air circulating fan alone being driven by the motor shown at 13. In FIG. 4, numeral 8 indicates a heater frame, numeral 14 indicates backside suction grills, numerals 17 and 18 indicate suction and emission grills on the indoor side, respectively, numeral 20 indicates an air filter, numeral 24 indicates a frontal cabinet of a synthetic resin material attached to the base plate 1, numeral 23 indicates another switch on the switch box 16 for setting the flow rate of the indoor air circulating fan 6 selectably to "high" H or "low" L, and numeral 27 indicates an interlocking switch for interlocking the on-off operations of the compressor 2 and the indoor circulating fan 6.

With reference to FIG. 5 which is a circuit diagram for the air conditioner of FIG. 4, the selection switch 21 is operated similarly to the one shown in FIG. 3. Explained more in detail, (1) when the selection switch 21 selects the COOL mode, its Terminals 7 and 5 and its Terminals 6 and 2 are connected together; (2) when the selection switch 21 selects the FAN mode, its Terminals 7 and 9 are connected together; (3) when the selection switch 21 selects the OFF mode, no terminals are connected together; and (4) when the selection switch 21 selects the HEAT mode, its Terminals 7 and 4 and its Terminals 6 and 2 are connected together. Numeral 22 indicates a thermo-switch having two connector pieces 32 and 33. The first connector piece 32 is adapted to become connected to Terminal H of the thermo-switch 22 if the temperature in the room is above a level set by the user and to Terminal L if the room temperature is below this set level. The second connector piece 33 is activated at a temperature lower than the aforementioned set level, closing if the room temperature is below this lower set temperature level. Temperature differentials are incorporated, as explained above in connection with FIG. 3, in order to prevent the chattering of the connector pieces 32 and 33 when the temperature approaches either of the temperature levels set therefor. Terminal H of the thermo-switch 22 is connected to Terminal 4 of the selection switch 21 and Terminal L of the thermo-switch 22 is connected through an antifreeze switch 34 to Terminal 5 of the selection switch 21. The anti-freeze switch 34 is installed so as to detect the temperature of the indoor heat exchanger 7 and opens when the temperature of the indoor heat exchanger 7 drops below the freezing point.

The motor 15 for the indoor air circulating fan 6 is provided not only with H and L Terminals (respectively for high and low air flow operations), as explained above, but also with a temperature (protect) switch 30 (with capacity corresponding to the current drawn by the motor 15) for detecting the temperature of the motor 15 (or, in particular, the temperature of its stator winding) such that when the temperature detected thereby exceeds a certain preset level, the electrical power supply to the stator winding is cut off and to thereby stop the operation of the motor 15. Numeral 31 indicates a capacitor for the operation of the inductive motor 15.

As shown in FIG. 5, the first connector piece 32 of the thermo-switch 22 is connected to an AC power supply through the temperature (protect) switch **19*a* for the heater 9, a (first) relay 35 and the protect switch 30 for the motor 15. The second connector piece 33 of the thermo-switch 22 is similarly connected to the AC power supply through another (second) relay 36 and the protect switch 30. A frost detector 26 is connected in parallel with the second connector piece 33 and the four-way valve FV 4 is connected between Terminal 4 of the selection switch 21** and the AC power supply.

The interlocking switch 27, as explained above in connection with FIG. 3, is so structured that its Terminal 2 can be connected selectably to either its Terminal 1 or 3. If its Terminals 2 and 3 are connected, Terminals 6 and 7 are effectively connected together such that the motor 15 is operated either in its high or low air flow mode if the selection switch 21 is selecting the COOL or HEAT mode without regard to whether the compressor 2 is being driven or stopped. If its Terminals 2 and 1 are connected, on the other hand, Terminal 6 of the selection switch 21 is effectively connected to Terminal A of the thermo-switch 22 and electrical power is supplied to the motor 15 only when power is being supplied to Terminal A of the thermo-switch 22 (that is, when the compressor 2 is operating). The first relay 35 is for controlling a normally-open connector RPA and the second relay 36 is for controlling a normally-open connector RDA and a normally-closed connector RDB which are adapted to be activated together.

The electric heater 9 is connected to the AC power supply through the normally-open connectors RPA and RDA and the fuse **19*b*. The motor 13 for the outdoor air circulating fan 12 is connected to the AC power supply through the normally-open connector RPA and the normally-closed connector RDB. The compressor 2 is connected to the AC power supply through the normally-open connector RPA, the normally-closed connector RDB and an overload-preventing switch 38 for stopping the supply of electrical power to the compressor 2** when an overload condition thereof is detected.

FIG. 6 is presented for showing the operations of the compressor 2, the electric heater 9, the outdoor air circulating fan 12 and the four-way valve 4, depending on the conditions of the first connector piece 32 of the thermo-switch 22 (H or L), the second connector piece 33 of the thermo-switch 22 (ON or OFF) and the frost detector 26 (ON or OFF) when the selection switch 21 is selecting the COOL or HEAT mode. If the first and second connector pieces 32 and 33 of the thermo-switch 22 are respectively at H and OFF and the frost detector 26 is in the OFF condition when the HEAT mode of operation (for heating the room) is selected, for example, operations of both the compressor 2 and the outdoor air circulating fan 12 are started. Since the four-way valve 4 in this situation is in the ON condition, the air conditioner serves as a heater. In the meantime, the indoor air circulating fan 6 is being operated at a set flow rate.

If the first and second connector pieces 32 and 33 of the thermo-switch 22 are respectively at H and ON in the HEAT mode of operation, both the compressor 2 and the outdoor air circulating fan 12 are stopped without regard to the ON/OFF condition of the frost detector 26 and electrical power is supplied to the electric heater 9. In other words, the room is heated by the electric heater 9 with the indoor air circulating fan 6 being operated.

If the air filter 20 becomes clogged or the indoor suction grills 17 become blocked so as to raise the temperature of the electric heater 9, electrical power supply to the heater 9 is stopped similarly as explained above in connection with FIG. 3. Similarly, electrical power supply to the compressor 2, the heater 9 and the outdoor air circulating fan 12 is shut off if the temperature inside the motor 15 becomes excessively high.

The foregoing description of preferred embodiments of the invention has been presented for purposes of illustration and description. It is not intended to be exhaustive or to limit the invention to the precise form disclosed, and obviously many modifications and variations are possible in light of the above teaching. Such modifications and variations which may be apparent to a person skilled in the art are intended to be included within the scope of the invention.

What is claimed is:

1. An electrical circuit for an air conditioner having a compressor, an electric heater and a motor for driving air circulating means, said electrical circuit comprising a first temperature switch which opens when the temperature of said motor exceeds a first temperature level, a thermostat for comparing room temperature detected thereby with a user-set temperature level, a relay connected to switch said compressor on and off, and a second temperature switch which opens when the temperature of said electric heater exceeds a second temperature level, said first temperature switch, said thermostat, said relay and said second temperature switch being connected in series to an AC power supply.

2. The electrical circuit of claim 1 wherein said air conditioner further includes an indoor heat exchanger, an outdoor heat exchanger and an expansion device, wherein said compressor, said indoor and outdoor heat exchangers and said expansion device form a refrigeration system, wherein said electric heater and said indoor heat exchanger are disposed in an air flow passage through which air is blown by said air circulating means, and wherein said air circulating means supply heated or cooled air to a room.

3. The electrical circuit of claim 2 wherein said motor has stator winding and said first temperature switch is connected in series with said stator winding and detects the temperature of said stator winding.

4. An electrical circuit for an air conditioner having a compressor, an electric heater, a motor for driving air circulating means, an indoor heat exchanger, an outdoor heat exchanger and an expansion device, said compressor, said indoor and outdoor heat exchangers and said expansion device forming a refrigeration system, said electric heater and said indoor heat exchanger being disposed in an air flow passage through which air is blown by said air circulating means, and said air circulating means supplying heated or cooled air to a room, said electrical circuit comprising a first temperature switch which opens when the temperature of said motor exceeds a first temperature level, a second temperature switch which opens when the temperature of said electric heater exceeds a second temperature level, a first thermostat which compares room temperature detected thereby with a user-set temperature level, a second thermostat which compares said room temperature with a third temperature level, a first relay connected to operate said compressor or connected to supply electric power to said electric heater, and a second relay connected to supply power selectively to said compressor or to said electric heater, said first temperature switch, said first thermostat, said first relay and said second temperature switch being connected in series to an AC power supply.

5. The electrical circuit of claim 4 wherein said motor has stator winding and said first temperature switch is connected in series with said stator winding and detects the temperature of said stator winding.

6. The electrical circuit of claim 4 wherein said first temperature switch and said second relay are connected in series.

7. The electrical circuit claim 6 wherein said second thermostat and said second relay are connected in series.

* * * * *